US007975734B2

(12) United States Patent
Makowiec et al.

(10) Patent No.: US 7,975,734 B2
(45) Date of Patent: Jul. 12, 2011

(54) LIGHTED FUNNEL

(76) Inventors: Martin Makowiec, Weatherly, PA (US); Emil Stola, Tresckow, PA (US)

( * ) Notice: Subject to any disclaimer, the term of this patent is extended or adjusted under 35 U.S.C. 154(b) by 313 days.

(21) Appl. No.: 12/316,947

(22) Filed: Dec. 18, 2008

(65) Prior Publication Data

US 2010/0154929 A1 Jun. 24, 2010

(51) Int. Cl.
*B65B 39/00* (2006.01)

(52) U.S. Cl. ..... 141/342; 141/331; 141/340; 141/341; 222/113

(58) Field of Classification Search ..... 141/331–345; 222/113; 385/147
See application file for complete search history.

(56) References Cited

U.S. PATENT DOCUMENTS

| | | | | |
|---|---|---|---|---|
| 5,960,907 | A * | 10/1999 | Chau | 184/105.1 |
| 5,967,201 | A * | 10/1999 | Gasior | 141/98 |
| 5,979,516 | A * | 11/1999 | Grant | 141/331 |
| 6,758,308 | B1 * | 7/2004 | Hearting et al. | 184/105.1 |
| 7,519,263 | B2 * | 4/2009 | Richards | 385/147 |
| 2006/0237478 | A1 * | 10/2006 | LaBuzetta | 222/113 |
| 2008/0099100 | A1 * | 5/2008 | Ferguson | 141/340 |

* cited by examiner

*Primary Examiner* — Timothy L Maust
(74) *Attorney, Agent, or Firm* — Rosenn, Jenkins & Greenwald LLP

(57) ABSTRACT

A lighted funnel, particularly a lighted funnel used to fill the fuel reservoir of an automobile, comprises (a) a funnel, (b) a handle, and (c) a means of automatically illuminating the funnel, such as a micro switch that is closed by the gravitational force on a weight. When the funnel is oriented in the upright position, the illumination means automatically lights the funnel and indicates to the user that the funnel is in a substantially level position. When the funnel is oriented in the downward position, the illumination means is automatically switched off.

7 Claims, 10 Drawing Sheets

LIGHTED FUNNEL

CROSS-REFERENCE TO RELATED APPLICATIONS

Not Applicable.

STATEMENT REGARDING FEDERALLY SPONSORED RESEARCH

Not Applicable.

BACKGROUND

1. Field of the Invention

The invention relates to the field of apparatus used to assist the transfer of fluids from one reservoir into another. In particular, the invention relates to funnels used to transfer fluids from a portable reservoir into a fixed reservoir, such as the fuel reservoir of a motor vehicle.

2. Description of the Related Art

The vast majority of motor vehicles in the world today are powered by the combustion of a petroleum-based fluid inside the combustion chamber of an engine. When in operation, the engine draws an amount of petroleum-based fluid from a fuel reservoir and then compresses the fluid to start the internal combustion process. As the combustion process continues, more fluid is drained from the fuel reservoir. Eventually, the fuel reservoir will be depleted of petroleum-based fluid and the engine will stop operating on account of the lack of fuel.

Accordingly, it is necessary to periodically replenish the fuel reservoir so that the engine continues to operate for as long as the user desires. With respect to automobiles, users typically monitor the amount of petroleum-based fluid remaining in the fuel reservoir with a gauge and replenish the fuel reservoir, when necessary, at a fueling station. Fueling stations are equipped with fuel dispensers designed to pump petroleum-based fluids directly into the fuel reservoir located inside the automobile.

There are times when a fueling station is not available. Perhaps the driver of the automobile failed to monitor the gauge indicating that the fuel reservoir was nearly empty which results in the cessation of the engine's operation due to a lack of fuel. Alternatively, the driver may realize he or she is about to exhaust the petroleum-based fluid in the fuel reservoir, but is not near a fueling station when the fuel reservoir is ultimately depleted. As a result, the driver typically finds him or herself stranded on a public road in need of a means to replenish the fuel reservoir in the automobile.

Replenishing the fuel reservoir in an automobile is difficult without a fueling station fuel dispenser. The difficulty stems from the spring-loaded valve located at the external end of the filler neck typically found in modern automobiles. The spring-loaded valve prevents vapor loss from the fuel reservoir. In addition to the spring-loaded valve, the circumference of the filler neck opening is typically quite small to further insure against vapor loss. When using a fuel dispenser, the nozzle attached to the end of the dispenser depresses the spring-loaded valve when it enters the filler neck to allow for the filling of the fuel reservoir. Without the fuel dispenser, the driver must figure out a way to depress the spring-loaded valve in such a way that petroleum-based fluids can enter the narrow circumference of the filler neck and then be passed through the filler neck.

The typical solution to this problem involves the use of a funnel. A typical funnel is a hollow cylinder with a wide conical mouth and a narrow stem. The stem can be inserted into the filler neck to depress the spring-loaded valve. Petroleum-based fluid is then poured into the conical mouth. This allows the user to pour the fluid through a receiving end of the funnel that has a larger circumference than the filler neck, while at the same time provides for the flow of fluid into the automobile's filler neck by keeping the spring-loaded valve depressed.

However, a simple funnel does not eliminate all difficulty associated with filling the fuel reservoir of an automobile. The user must figure out the best way to keep the funnel as level along a horizontal plane as possible in order to avoid, as much as possible, spilling any of the petroleum-based fluid being poured into the mouth of the funnel. In addition, if the user's automobile has become inoperable at night, the user must ensure that he or she is able to see the funnel so as to avoid pouring the fluid outside of the funnel mouth's circumference. An additional problem that the user may encounter is the need to support the funnel against the filler neck opening; otherwise the funnel may fall out of the filler neck because the filler neck's opening is tilted predominantly towards a vertical plane.

Attempts have been made to solve of the aforementioned problems. For example, U.S. Pat. No. 7,270,159 to Burns discloses a spilless funnel comprising adjustable legs that stabilize the funnel apparatus and a mounting collar allowing the funnel to be mounted to the reservoir being filled. U.S. Pat. No. 6,715,647 to Ivins discloses a funnel apparatus comprising a holster and stand to stabilize the funnel above the reservoir being filled. U.S. Pat. No. 5,899,246 to Cummins, et al. discloses a funnel with appendages affixed to the body of the funnel that allows the funnel body to stand upright when positioned within the opening of the reservoir to be filled. U.S. Pat. No. 5,803,140 to Joboin discloses an oil drain funnel comprising a magnetic means for attaching the funnel to the automobile from which oil is being drained. U.S. Pat. No. 5,607,004 to Cope discloses a funnel apparatus comprising a plurality of clamping members that position the funnel in place vis a vis the reservoir to be filled.

None of the funnels described above individually solve the problems of (i) indicating to the user when the funnel is level and (ii) allowing the user to observe the funnel in dark conditions. Moreover, none of the funnels described above individually solve the aforementioned problems and support the funnel to ease the transport of fluid. Accordingly, there is a need for a funnel apparatus that can solve some or all of the aforementioned problems.

SUMMARY

The present invention is directed to a funnel apparatus that satisfies this need of a funnel capable of solving the problems of stability and illumination. A funnel having features of the present invention comprises a funnel body, with a conical mouth and narrow stem, and a lighting means that automatically turns on when the top rim of the funnel body is parallel with the ground. In a preferred embodiment, the funnel apparatus having features of the present invention further comprises a means for temporarily attaching the funnel to a surface so that the funnel is held in an upright position.

DETAILED DESCRIPTION

In the Summary above, and in the Detailed Description and the claims below, reference is made to particular features of the invention. It is to be understood that the disclosure of the invention in this specification includes all appropriate combinations of such particular features. For example, where a particular feature is disclosed in the context of a particular embodiment or a particular claim, that feature can also be used, to the extent appropriate, in the context of other particular embodiments and claims, and in the invention generally.

DEFINITIONS

Where the definition of terms departs from the commonly used meaning of the term, applicant intends to utilize the definitions provided below. For purposes of the present invention, the term "upright position" refers to an orientation of the funnel apparatus wherein the conical mouth (as identified below) is oriented above the narrow stem (as identified below) and the rim of the conical mouth is oriented in a position that is or is nearly parallel to the ground. For purposes of the present invention, the term "downward position" refers to any orientation of the funnel apparatus that is not the upright position.

DESCRIPTION

Figure 1:
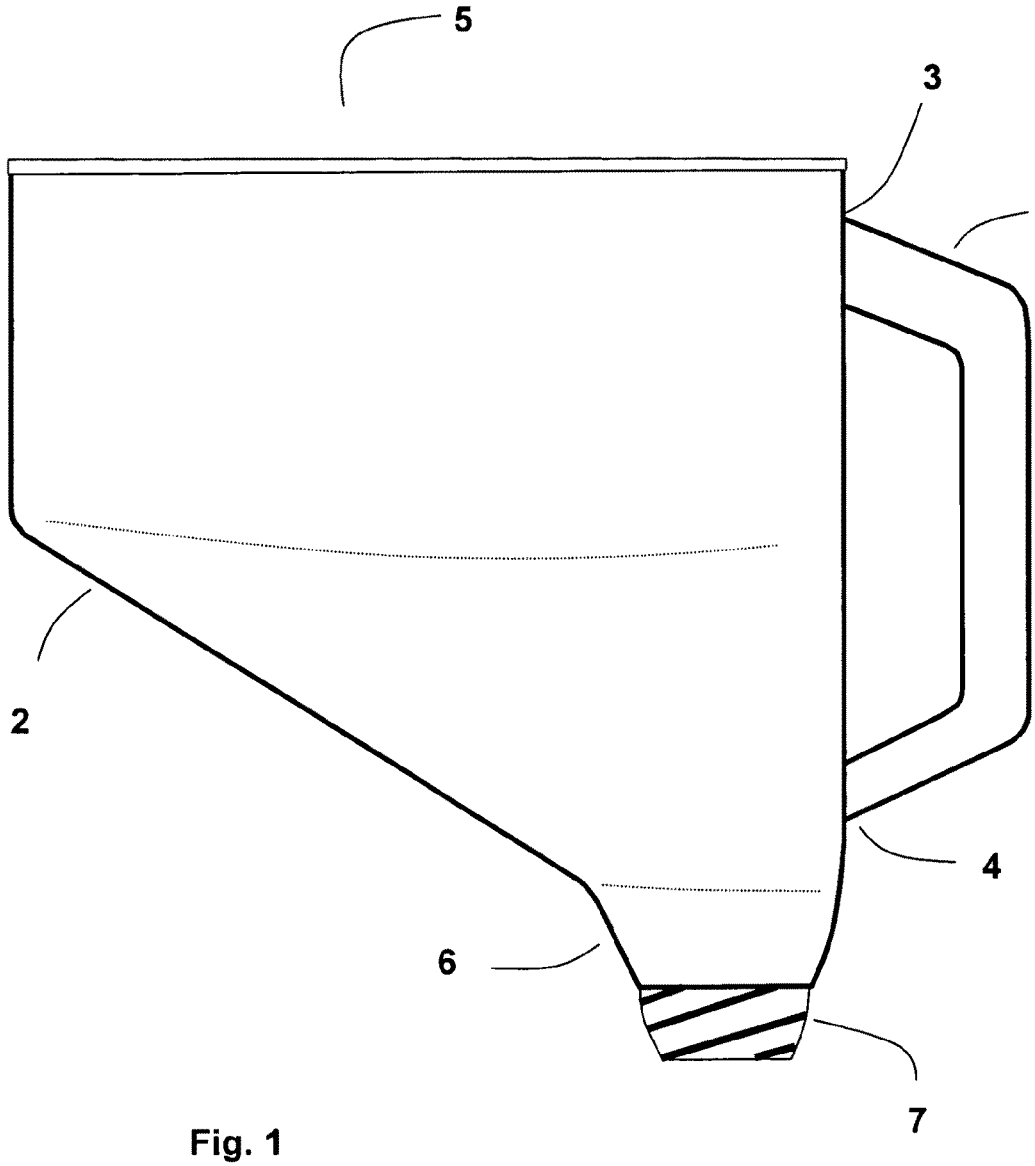
FIG. 1 is a side elevation view of a funnel device embodying features of the present invention.

As shown in FIG. 1, a funnel apparatus comprises a handle 1 attached to a funnel 2. The handle 1 is preferably U-shaped and attached to the funnel 2 at the handle's 1 first end 3 and second end 4, preferably by any permanent means of attachment. The handle 1 can be made of any solid material, and is preferably made of plastic. The funnel 2 comprises a conical mouth 5 and a narrow stem 6. The funnel 2 can be any shape that will allow a fluid to be poured into the conical mouth 5 and drained through the narrow stem 6. In a preferred embodiment, the narrow stem 6 has a threaded opening 7, as is shown in the embodiment in FIG. 1. The threaded opening 7 allows for tools, such as a hose, to be attached to the narrow stem 6. The funnel 2 can be made of any solid material, and is preferably made of plastic.

Figure 2:
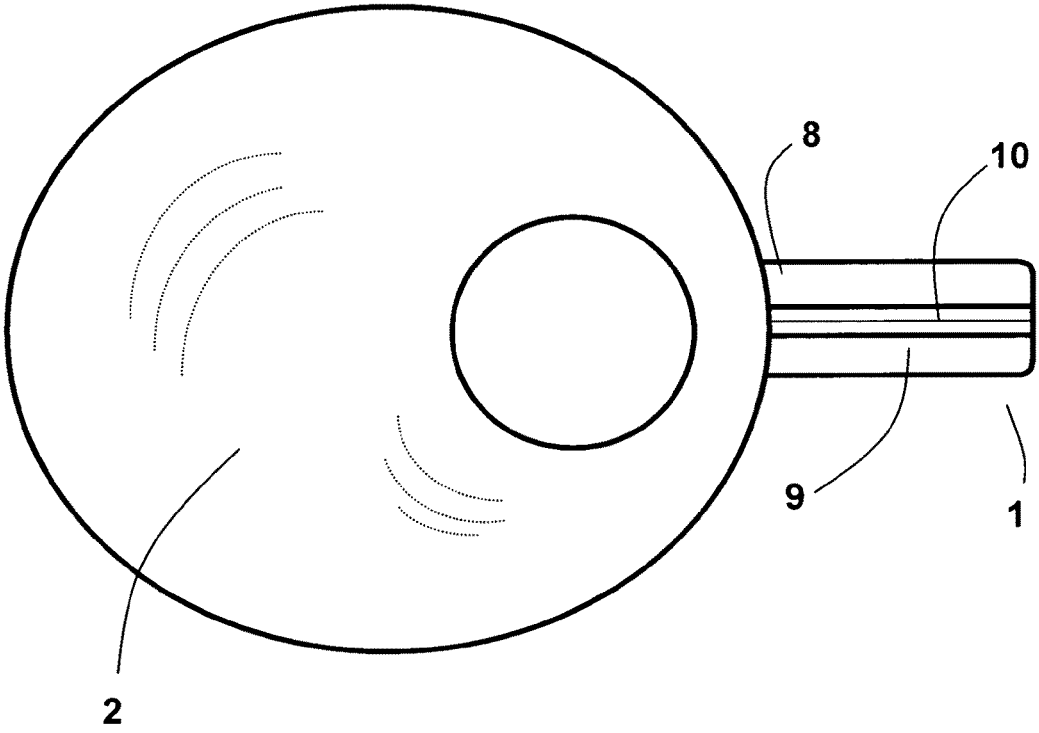
FIG. 2 is a top plan view of a funnel device embodying features of the present invention.

As shown in FIG. 2, the handle 1 has a first chamber 8 and a second chamber 9. The first chamber 8 and the second chamber 9 are separated by a barrier 10. In a preferred embodiment shown in FIG. 2, the first chamber 8 and the second chamber 9 are each ¼" wide, but the chambers 8, 9 can be any width.

Figure 3:
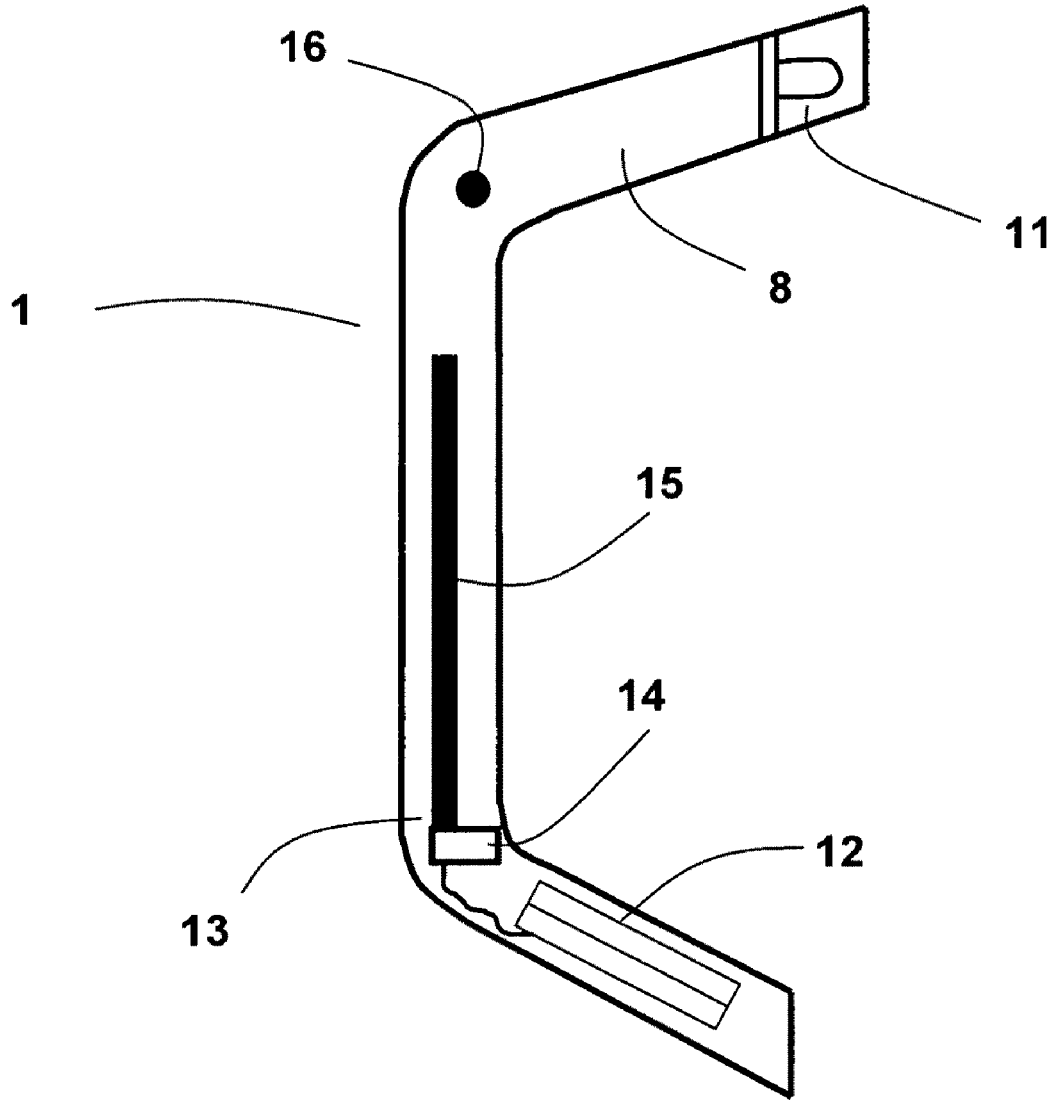
FIG. 3 is a sectional view of the handle of a funnel device embodying features of the present invention.

As shown in FIG. 3, the first chamber 8 comprises a first lighting means 11, a power means 12, and a switch 13. In the preferred embodiment shown in FIG. 3, the first lighting means 11 comprises a 5 mm white LED, the power means 12 comprises four 3V lithium batteries, and the switch 13 comprises a standard microswitch 14 (e.g., Honeywell® ZV Series, Subminiature Basic Switch, product #ZV10B10E01) and a weight 15. As shown in the embodiment of FIG. 3, the weight 15 comprises a 18 gram solid lead weight. The weight 15 is shaped to fit the internal dimensions of the first chamber 8 in such a way that allows the weight 15 to move up and down inside the first chamber 8 in response to a gravitational force. Moreover, the weight 15 is substantially shaped as a rectangular prism and shaped in such a way that creates a small amount of friction at the point of contact between the weight 15 and the walls of the first chamber 8. In a preferred embodiment, the first chamber 8 further comprises a plastic stopper 16.

Figure 4:
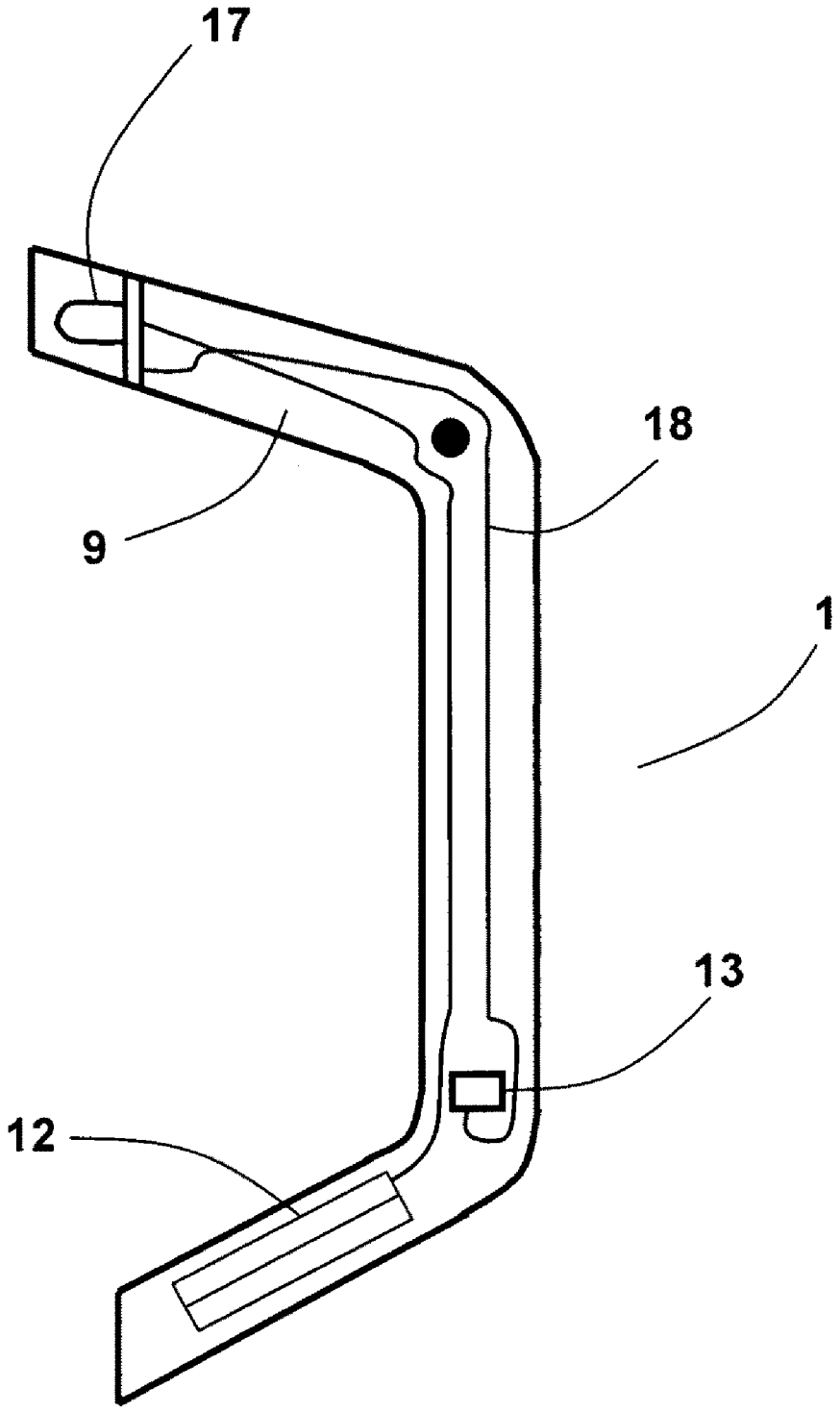
FIG. 4 is a sectional view of the handle of a funnel device embodying features of the present invention.

As shown in FIG. 4, the second chamber 9 comprises a second lighting means 17, a power means 12, and a switch 13. In the preferred embodiment shown in FIG. 4, the second lighting means 17 comprises a 5 mm white LED, the power means 12 comprises two 3V lithium batteries that pierce the barrier 10 of the first chamber 8 and second chamber 9, and the switch 13 comprises a standard microswitch 14 that also pierces the barrier 10 between the first chamber 8 and second chamber 9. In a preferred embodiment, the second chamber 9 further comprises wires 18 that connect the power means 12, the micro switch 14, the first lighting means 11, and the second lighting means 17 in a series circuit.

Figure 5:
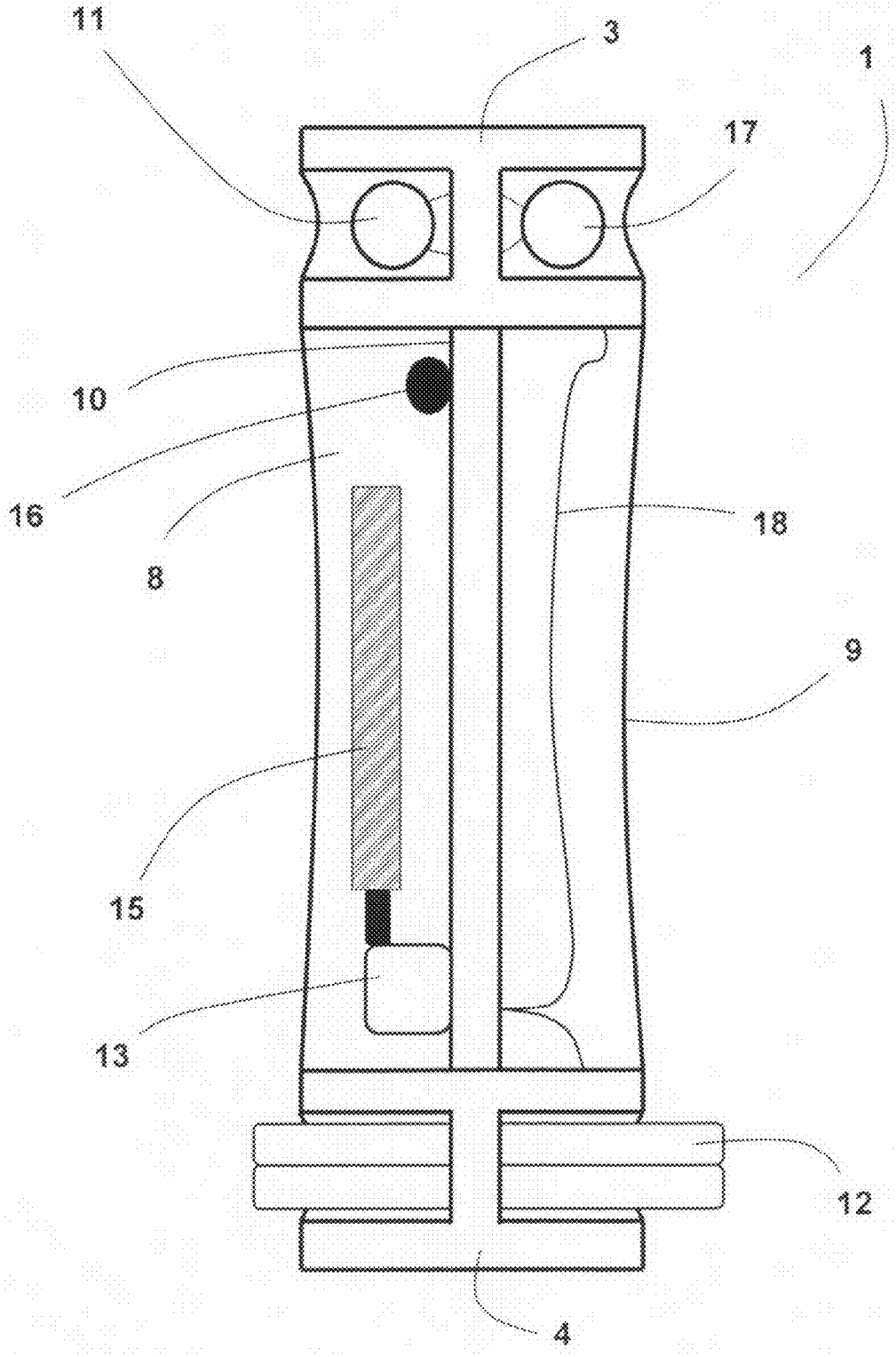
FIG. 5 is a sectional view of the handle of a funnel device embodying features of the present invention.
Figure 6:
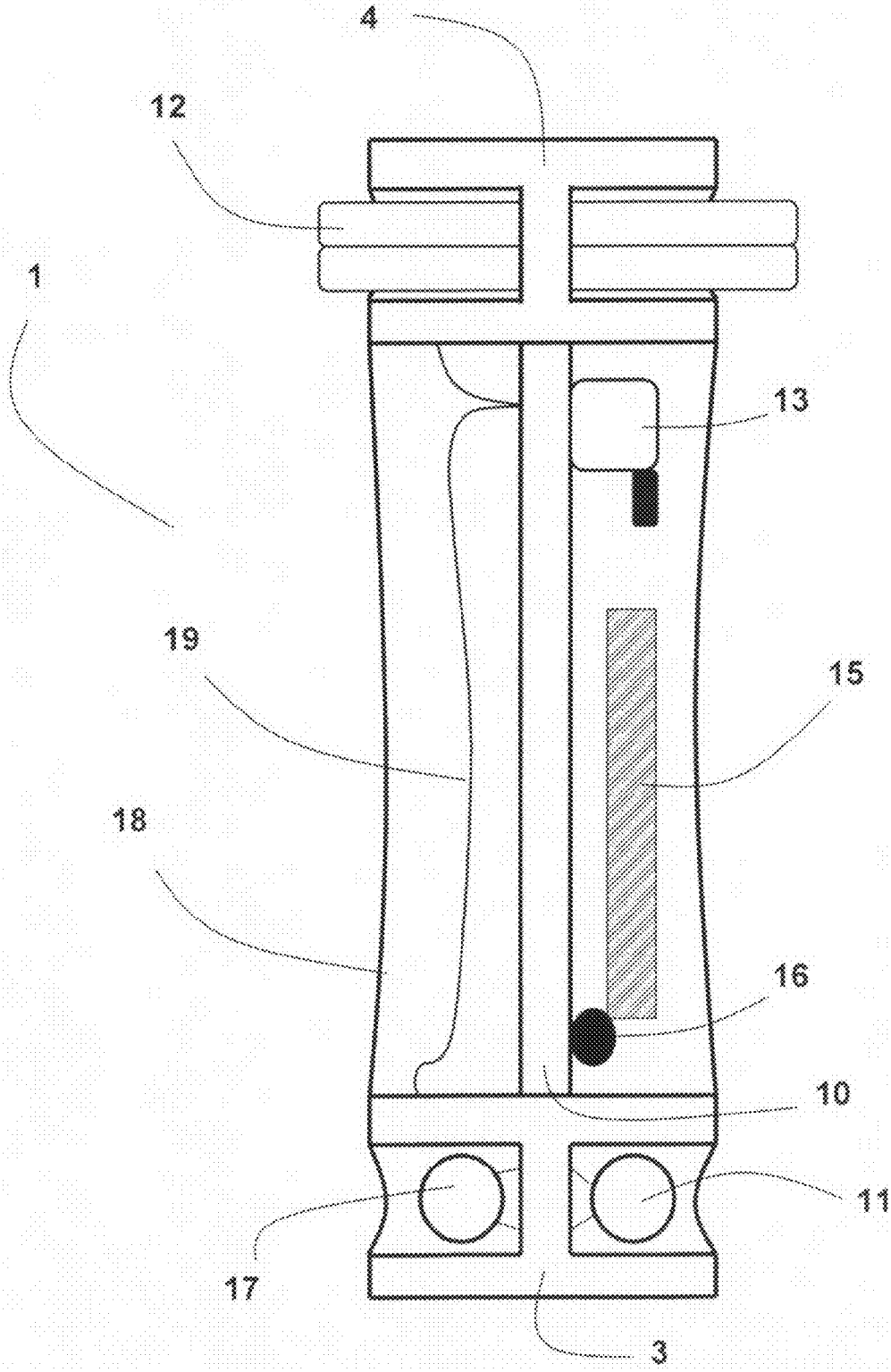
FIG. 6 is a sectional view of the handle of a funnel device embodying features of the present invention.

As shown in FIGS. 5 and 6, in a preferred embodiment of the handle 1, the first chamber 8 and the second chamber 9 are separated by the barrier 10. The first lighting means 11 and the second lighting means 17 are permanently positioned at the first end 3 of the handle 1. The power means 12 pierces the barrier 10 and is positioned at the second end 4 of the handle 1. The micro switch 14 also pierces the barrier 10 and is located at the base of the handle 1 toward the second end 4. The wires 18 are connected to the micro switch 14 and threaded through the second chamber 9 where they are connected to the first lighting means 11 and to the second lighting means 17. The plastic stopper 16 is positioned in the first chamber 8 towards the first end 3 of the handle 1.

In use, the funnel apparatus identifies when the funnel apparatus is in the upright position and allows a user to observe the operation of the funnel in dark conditions.

When the funnel apparatus is oriented in the upright position as is shown in FIG. 1, gravity forces the weight 15 to fall and close the micro switch 14 as is shown in FIGS. 3 and 5. The small amount of friction created at the point of contact between the weight 15 and the walls of the first chamber 8 keeps the weight 15 from sliding down the first chamber 8 until the funnel apparatus is substantially in the upright position. The closing of the micro switch 14 completes the series circuit that includes the wires 18, the power means 12, the micro switch 14, the first lighting means 11, and the second lighting means 17. Accordingly, the power means 12 introduces an electrical current to the series circuit that is carried up through the second chamber 9 by the wires 18 causing the first lighting means 11 and the second lighting means 17 to light up.

In contrast, when the funnel apparatus is oriented in the downward position as shown in FIG. 6, gravity forces the weight 15 toward the plastic stopper 16 and away from the micro switch 14 causing the micro switch 14 to open. The opening of the micro switch 14 breaks the series circuit which causes the first lighting means 11 and the second lighting means 17 to turn off.

Figure 7:
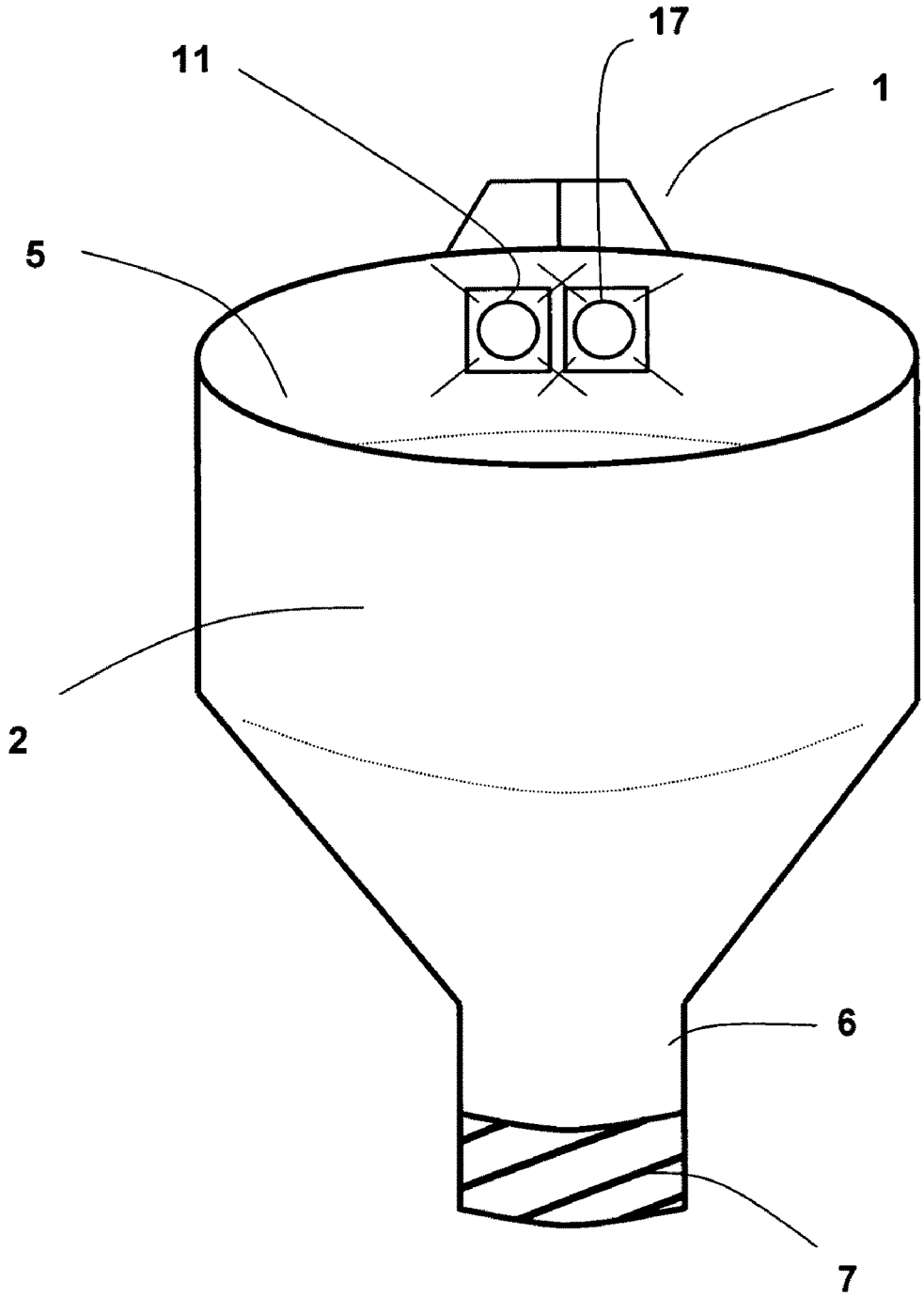
FIG. 7 is a perspective view of a funnel device embodying features of the present invention.

A user will store the funnel apparatus in the downward position. As explained above, the downward position forces the weight 15 away from the micro switch 14 which causes the first lighting means 11 and the second lighting means 17 to be turned off. When the user needs to use the funnel apparatus, he will turn the funnel apparatus towards the upright position. When the funnel apparatus has been turned far enough to where the small amount of friction between the weight 15 and the wall of the first chamber 8 is overcome, the weight 15 slides down the first chamber 8 of the handle 1 and closes the micro switch 14 thereby completing the series circuit in the handle 1. Since the funnel apparatus can only be efficiently used to funnel fluid from one reservoir into another when the funnel apparatus is in the upright position, the user will only need the funnel apparatus illuminated when it is in the upright position. Moreover, because the small amount of friction will cause the weight 15 to only close the micro switch 14 when the conical mouth 5 is oriented in the upright position, the activation of the first lighting means 11 and the second lighting means 17 will inform the user of when the rim of the conical mouth 5 is oriented in a position that is or is nearly parallel to the ground, as is shown in FIG. 7. This is the position of the funnel apparatus that provides maximum protection against spilling fluid over the rim of the conical mouth 5.

Figure 8:
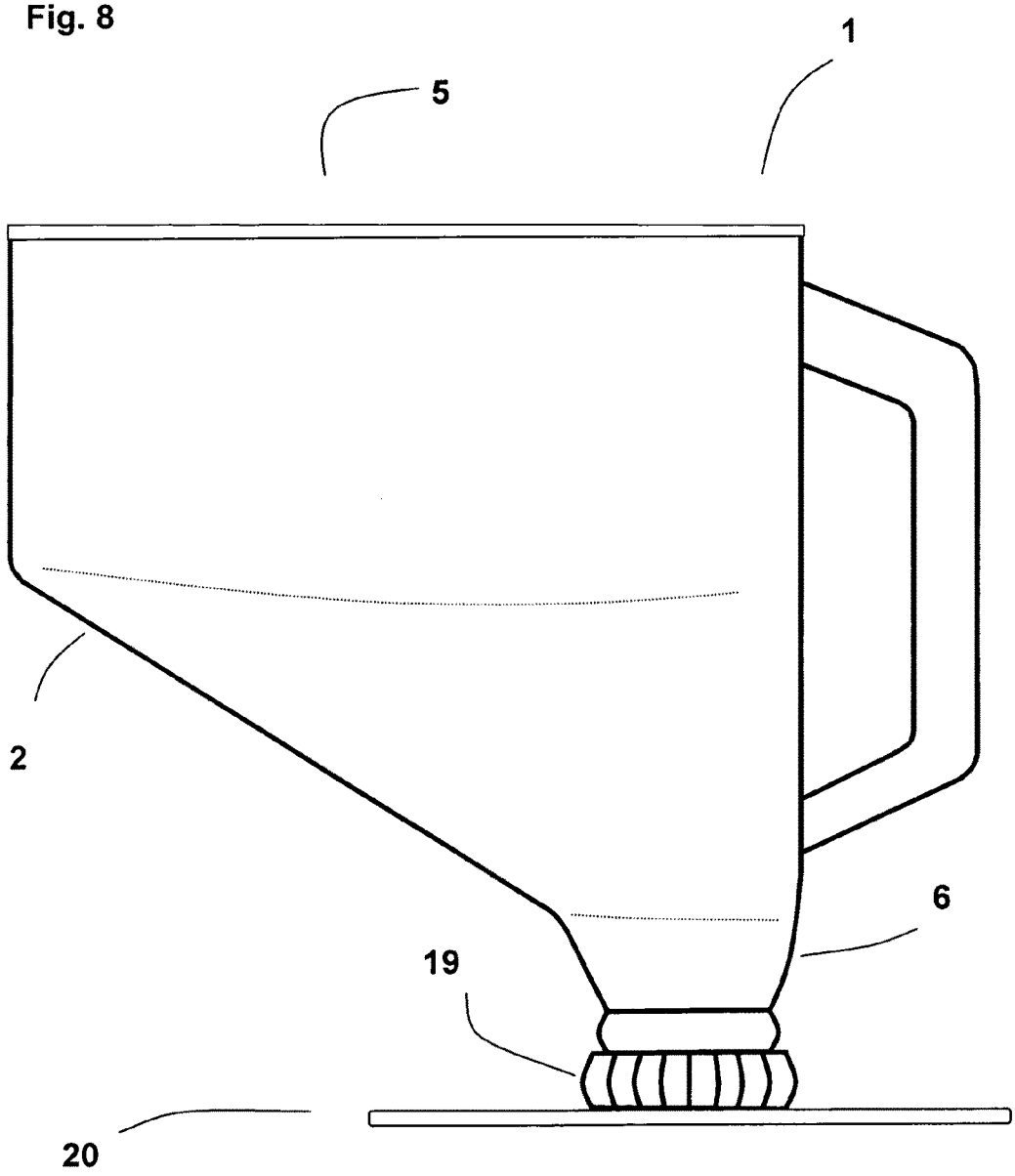
FIG. 8 is a side elevation view of another version of a funnel device embodying features of the present invention.

FIG. 8 shows a preferred embodiment of the funnel apparatus that comprises a threaded cap 19 and a lid 20. The threaded cap 19 is shaped like a standard threaded cap found on plastic 20 oz. bottles and is dimensioned to fit over the threaded opening 7 of the narrow stem 6 of the funnel 2. The lid 20 is preferably constructed of plastic and is dimensioned to fit snuggly over the conical mouth 5 of the funnel 2. The top of the threaded cap 19 is permanently attached to the top of the lid 20. As is shown in FIG. 7, when the threaded cap 19 is attached to the narrow stem 6, the lid 20 allows the funnel 2 to stand upright with the conical mouth 5 open. In addition, the threaded cap 19 can be removed from the narrow stem 6 and the lid can then cover the conical mouth 5, preventing fluid from entering the funnel 2 via the conical mouth 5.

Figure 9:
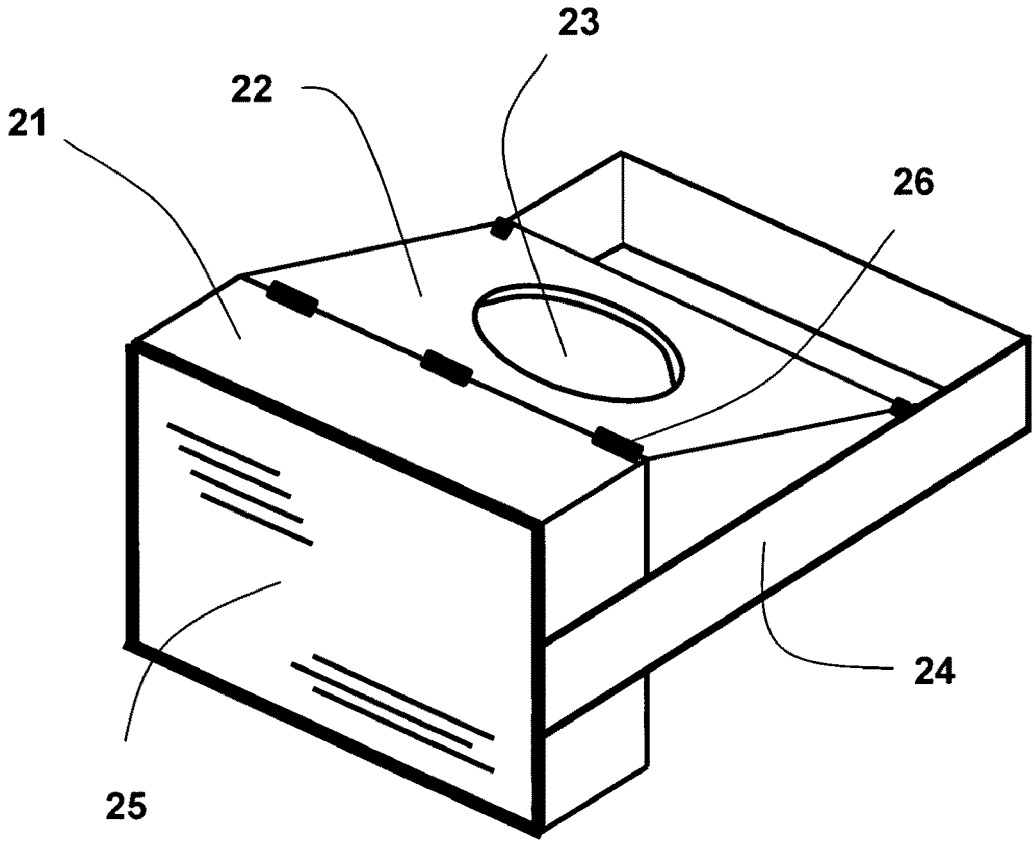
FIG. 9 is a perspective view of a holding device embodying features of the present invention.

A preferred embodiment of a funnel apparatus embodying features of the present invention further comprises a holding means, such as the one shown in FIG. 9. As shown in FIG. 9, the holding means may comprise a handle 24 permanently attached to a magnet 21 and a plate 22. The plate 22 comprises a hole 23. The magnet 21 can be any industrial strength magnet (e.g., a 2" by ⅞" ceramic magnet). The magnet 21 is attached to the handle 24 by any permanent means of attachment, such as welding. The handle 24 may be constructed from any solid material and is preferably constructed out of metal. The plate 22 is attached to the handle 24 by any permanent means of attachment. In the embodiment shown in FIG. 8, the plate 22 is welded 26 to the handle 24 and the magnet 21. In a preferred embodiment of the holding means, a rubber cover 25 is attached to the magnet 21.

Figure 10:
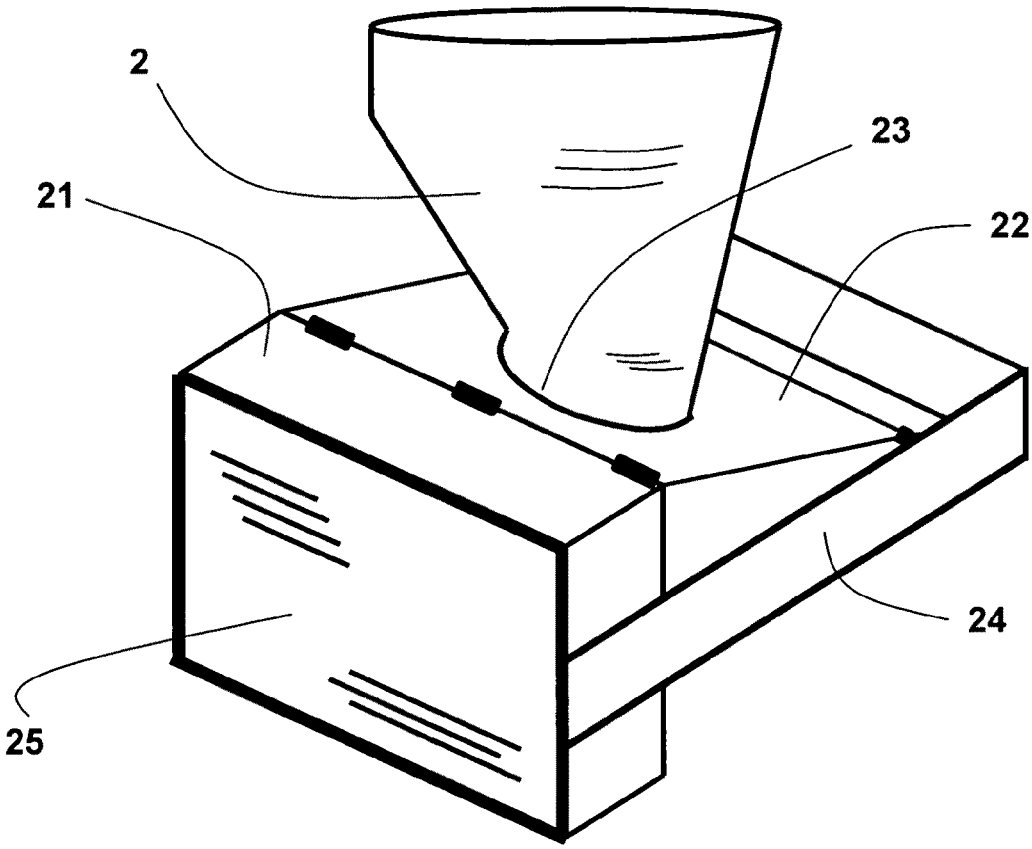
FIG. 10 is a perspective view of a holding device and a funnel device embodying features of the present invention.

As is shown in FIG. 10, when in use, the funnel 2 is threaded through the hole 23 of the plate 22. The plate 22 thereby holder the funnel 2 in the upright position. Using the handle 24, a user may attach the holding means to a metal surface using the magnet 21. The rubber cover 25 protects the metal surface from being damaged by the magnet 21.

What is claimed is:

1. A lighted funnel apparatus, comprising:

(a) a funnel, said funnel comprising a conical mouth, a rim and a narrow stem;

(b) a handle, said handle comprising a first chamber and a second chamber; and (c) a lighting means, said lighting means being positioned so as to illuminate the rim and interior of said conical mouth, and wherein said lighting means is automatically switched on by an automated system when said funnel apparatus is oriented in the upright position, said automated system being completely contained in said handle and comprising a weight positioned inside said first chamber, where said weight is shaped in such a way as to create friction between said weight and the interior of said first chamber.

2. The lighted funnel apparatus of claim 1, wherein said lighting means comprises a 5 mm white LED.

3. The lighted funnel apparatus of claim 1, wherein said funnel and said handle are made of plastic.

4. The lighted funnel apparatus of claim 1, wherein said automated system comprises:

(a) a micro switch; and (b) a power means.

5. The lighted funnel apparatus of claim 1, further comprising a holding means.

6. The lighted funnel apparatus of claim 5, wherein said holding means orients said funnel apparatus in the upright position.

7. The lighted funnel apparatus of claim 5, wherein said holding means comprises a magnet.

* * * * *